US006904855B2

(12) United States Patent
Xu

(10) Patent No.: US 6,904,855 B2
(45) Date of Patent: Jun. 14, 2005

(54) PATCHWORK FABRIC ARTICLE AND METHOD

(75) Inventor: Lawrence Xu, Walnut, CA (US)

(73) Assignee: David Textiles, Inc., City of Commerce, CA (US)

( * ) Notice: Subject to any disclaimer, the term of this patent is extended or adjusted under 35 U.S.C. 154(b) by 128 days.

(21) Appl. No.: 10/394,595

(22) Filed: Mar. 24, 2003

(65) Prior Publication Data

US 2004/0221784 A1 Nov. 11, 2004

(51) Int. Cl.[7] ..... D05B 11/00; D05B 35/06

(52) U.S. Cl. ..... 112/475.08; 112/417; 112/117

(58) Field of Search ..... 112/475.08, 117, 112/405, 412, 417, 475.22, 475.01; 428/32, 36.1, 37, 102, 107, 111; 139/416, 417, 419

(56) References Cited

U.S. PATENT DOCUMENTS 2,260,052 A * 10/1941 Passavant ..... 428/102
3,252,676 A * 5/1966 Frieder ..... 244/145
3,719,962 A * 3/1973 Burkley ..... 5/604
3,730,247 A * 5/1973 White ..... 152/367
4,097,631 A * 6/1978 Wilken ..... 428/114
4,244,996 A * 1/1981 Maloney ..... 428/103
4,646,666 A * 3/1987 Burrier ..... 112/475.22
6,357,370 B1 * 3/2002 Fritz et al. ..... 112/475.01

* cited by examiner

*Primary Examiner*—Ismael Izaguirre
(74) *Attorney, Agent, or Firm*—Rapkin, Gitlin & Beaumont

(57) ABSTRACT

A textile fabric comprising a plurality of pieces of fabric material cut into strips, which are then placed adjacent to one another and interlaced. The interlaced strips are situated transverse of one another and allow for overlapping edges. Recessed from these edges along a generally parallel line are rows of stitching employed to join the pieces of fabric. The result enables the appearance of a simulated patchwork design.

A method to construct a textile fabric with the realistic appearance of patchwork design comprising the steps of providing pieces of fabric material formed into strips of generally equal length and width, placing a first series of the strips in juxtaposed relation and a second series of the strips in a juxtaposed relation and situated transverse to and covering the first series of strips, interlacing the two series of strips to form a top and bottom surface of textile fabric, arranging the transversely related series of strips so that their edges overlap, and stitching the series of strips along a line generally parallel to and recessed from the edges.

9 Claims, 5 Drawing Sheets

PATCHWORK FABRIC ARTICLE AND METHOD

BACKGROUND OF THE INVENTION

1. Field of the Invention

The present invention relates generally to the field of textiles and, more particularly to a simulated patchwork fabric article and the method for manufacturing the same.

2. Description of the Prior Art

The patchwork design or "look", including patchwork quilts, blanketthrows and other types of bed coverings, and even wall hangings, have a long history in the prior art. The history of patchwork designs and the fabric articles that embody these designs actually goes back over 500 years where quilting had its origins in Asia and Europe and then eventually was introduced in the United States by the Amish in the mid $18^{th}$ Century. Amish quilts, for example, are unique in that they are made from solid color fabric having both bright and somber colors. The Amish patterns are typically geometric incorporating ornate or elaborate designs. Quilting was introduced in Hawaii by New Englanders. Most Hawaiian quilts are made from whole pieces of solid cloth which incorporate appliqued patterns that are commonly sewn over neutral colored backgrounds. Another version of the quilt, the Crazy Quilt, consists of various types, colors and textures of cloth randomly sewn together.

Quilts were often the result of the frugal use of bits and pieces of leftover or unused fabric joined together to produce a covering to keep warm or use as a decoration. Quilts often reflected the history of the times, or a particular family history. Whatever their purpose, they were unique and attractive. And, due to the original aspects of their artwork and the investment of time in handcrafting the article, quilts were and, particularly handcrafted versions, continue to be highly in demand.

Patchwork quilt reproductions, though usually not the product of tedious, skilled and creative handcrafting, often appear just as aesthetic appealing and enjoyable as the originals. Certain reproductions require joining larger or longer pieces of fabric use methods other than conventional hand stitchery, including even adhesives. Simulated stitches may even be employed to give the appearance of the genuine item though this variety is not nearly as popular as the genuinely stitched version. Machine or mechanically sewn patchwork fabric materials have been manufactured for many years. They obviously can be made more efficiently and for much less cost than their handcrafted counterparts. But, machine sewn patchwork quilts typically are not as attractive or as highly regarded.

The present invention is directed to a patchwork fabric article and a method of manufacture of the article to achieve a product that simulates the valuable and most aesthetically pleasing aspects of the genuine article, but without its major deficiencies.

SUMMARY OF THE INVENTION

In its preferred embodiment the present invention provides a textile fabric comprising a plurality of pieces of fabric material cut into strips, which are then placed adjacent to one another and interlaced. Series of these interlaced strips are situated transverse of one another and allow for overlapping edges. Recessed from these edges along an imaginary parallel line extend a series of rows of stitching employed to join and secure the pieces of fabric. The culmination of this process enables the appearance or simulation of a genuine patchwork design.

The method to construct a textile fabric with the realistic appearance of patchwork design comprises the steps of providing pieces of fabric material formed into strips of generally equal length and width, placing a first series of the strips in juxtaposed relation and a second series of the strips in a juxtaposed relation and situated transverse to the first series of strips, interlacing the two series of strips to form a top and bottom surface of textile fabric, arranging the transversely related series of strips so that their edges overlap and stitching the series of strips along a line parallel to and recessed from the edges.

Accordingly, it is an object of the present invention to provide an improved patchwork fabric article.

Another object of the present invention is to provide an improved method of manufacture of the patchwork fabric article.

Still another object of the present invention is to provide an improved patchwork fabric article that simulates the appearance of a genuine patchwork quilt.

Still another object of the present invention is to provide an improved patchwork fabric article that is easy and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
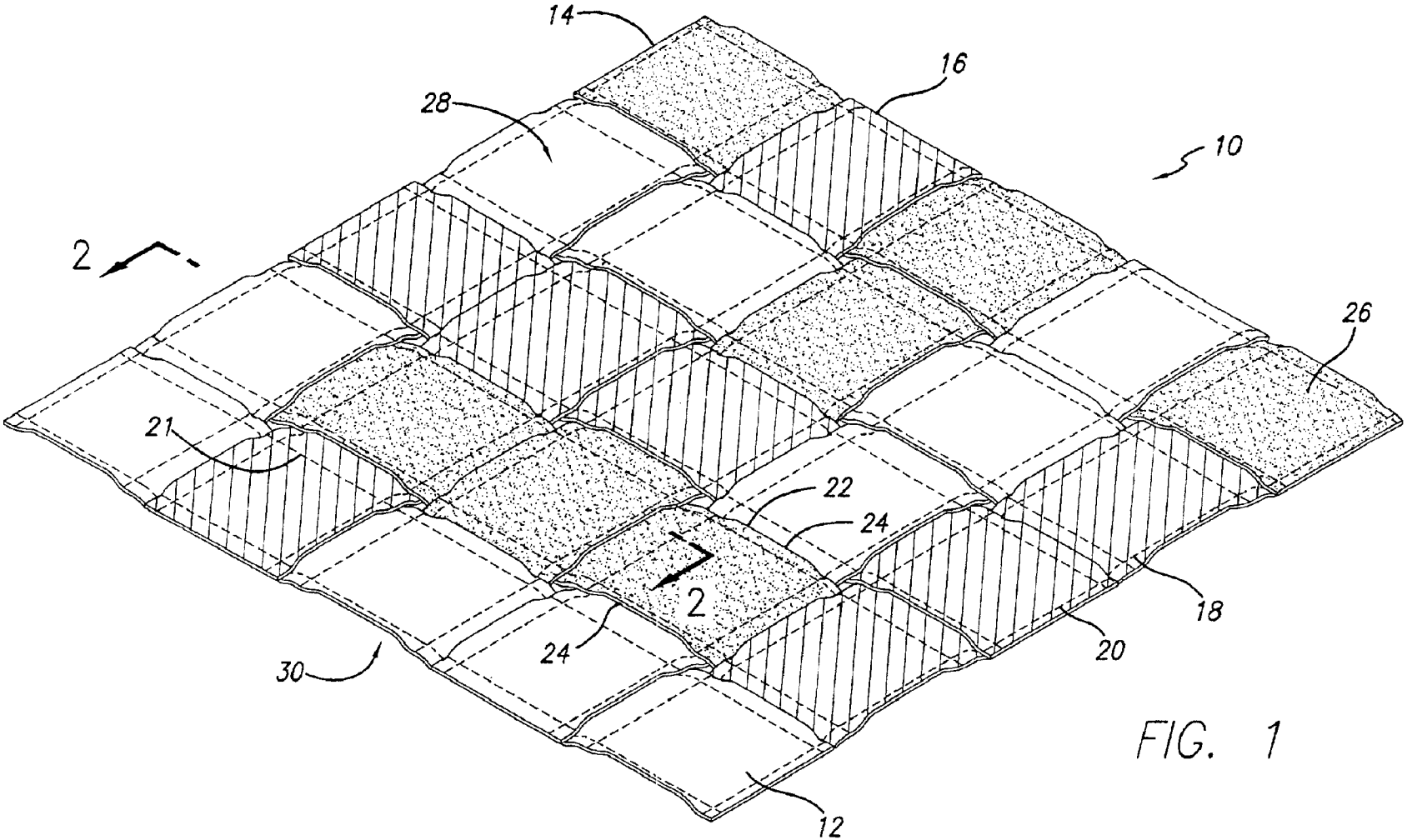
FIG. 1 is a perspective view of the improved patchwork fabric article according to the present invention.
Figure 2:
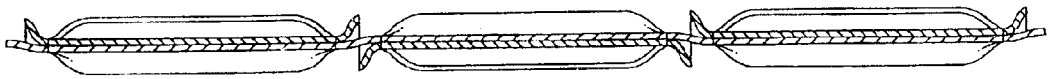
FIG. 2 is a view of the improved patchwork fabric article of the present invention taken along line 2—2 of FIG. 1.
Figure 3:
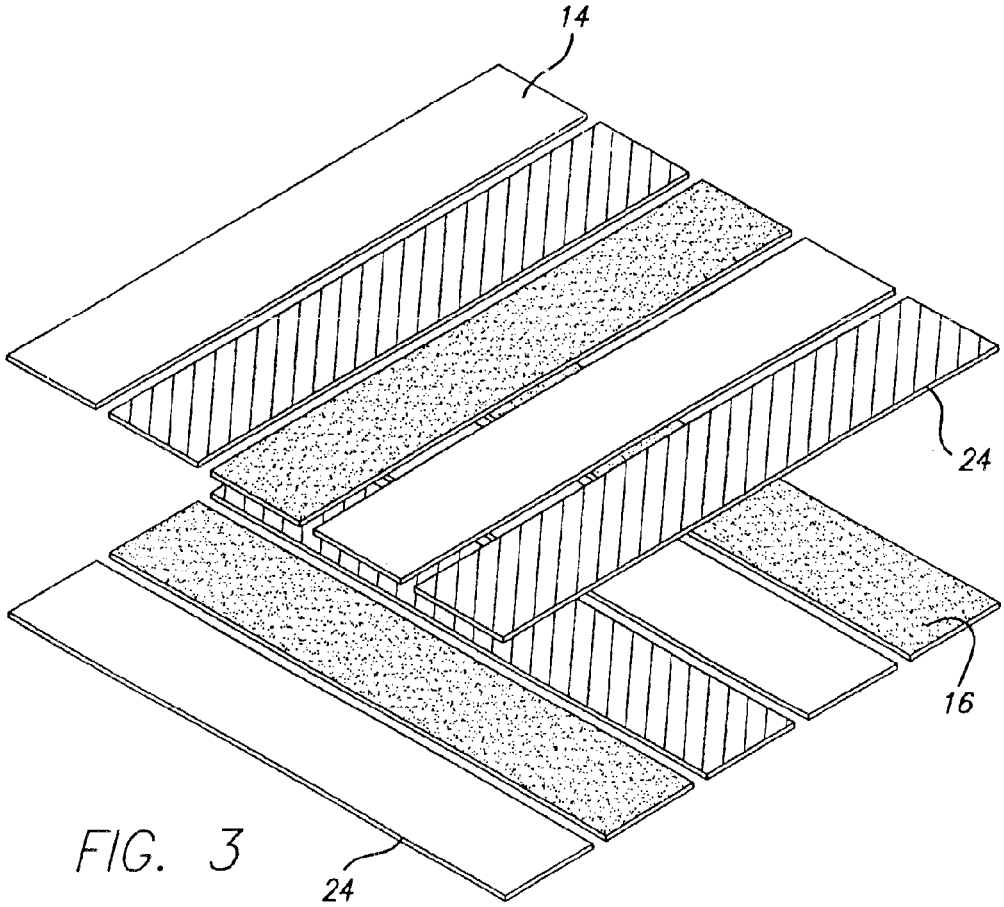
FIG. 3 is an exploded view of the individual transverse strips of fabric before the strips are interlaced according to the present invention.
Figure 4:
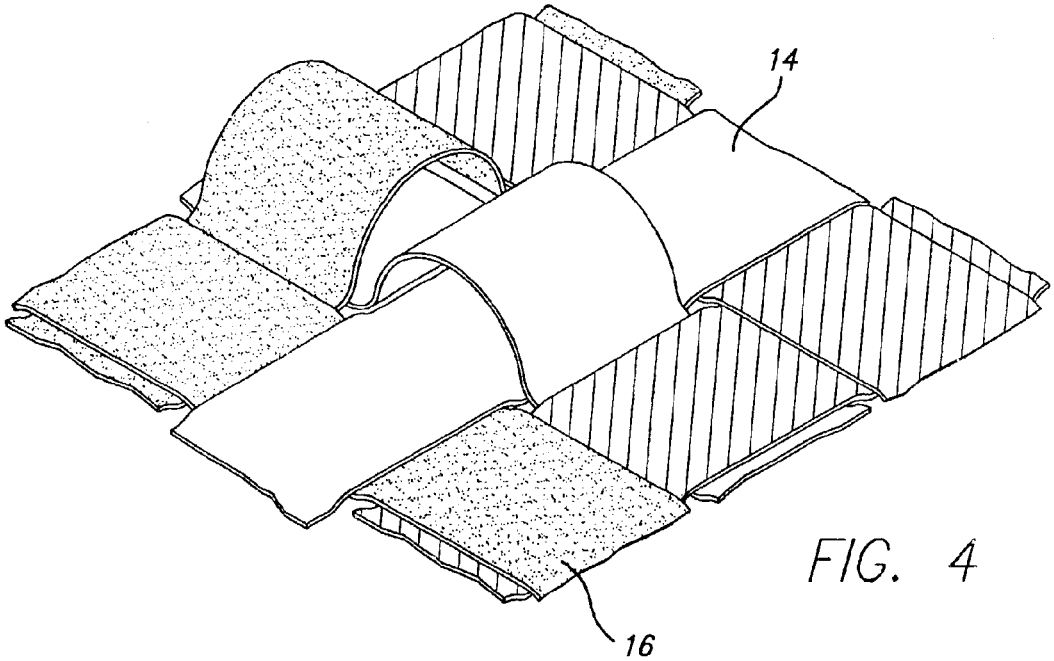
FIG. 4 is a perspective view of the interlaced fabric strips according to the present invention.
Figure 5:
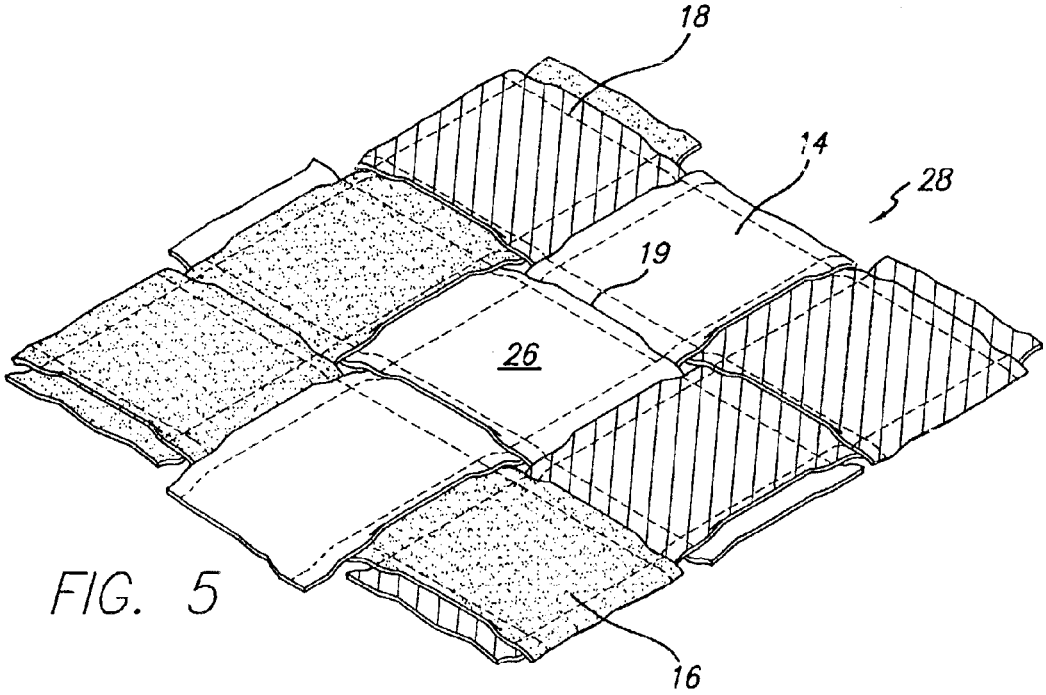
FIG. 5 is a top perspective view of a section of the interlaced and stitched fabric strips according to the present invention.
Figure 6:
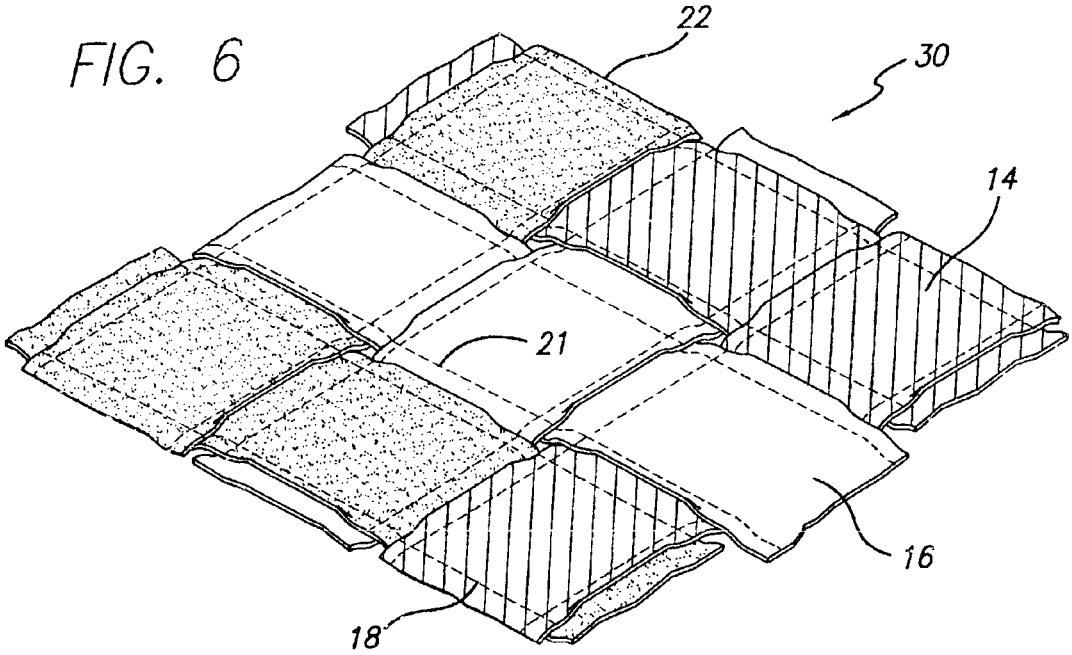
FIG. 6 is a bottom perspective view of the same section of the interlaced and stitched fabric strips, as shown in FIG. 5, according to the present invention.
Figure 7:
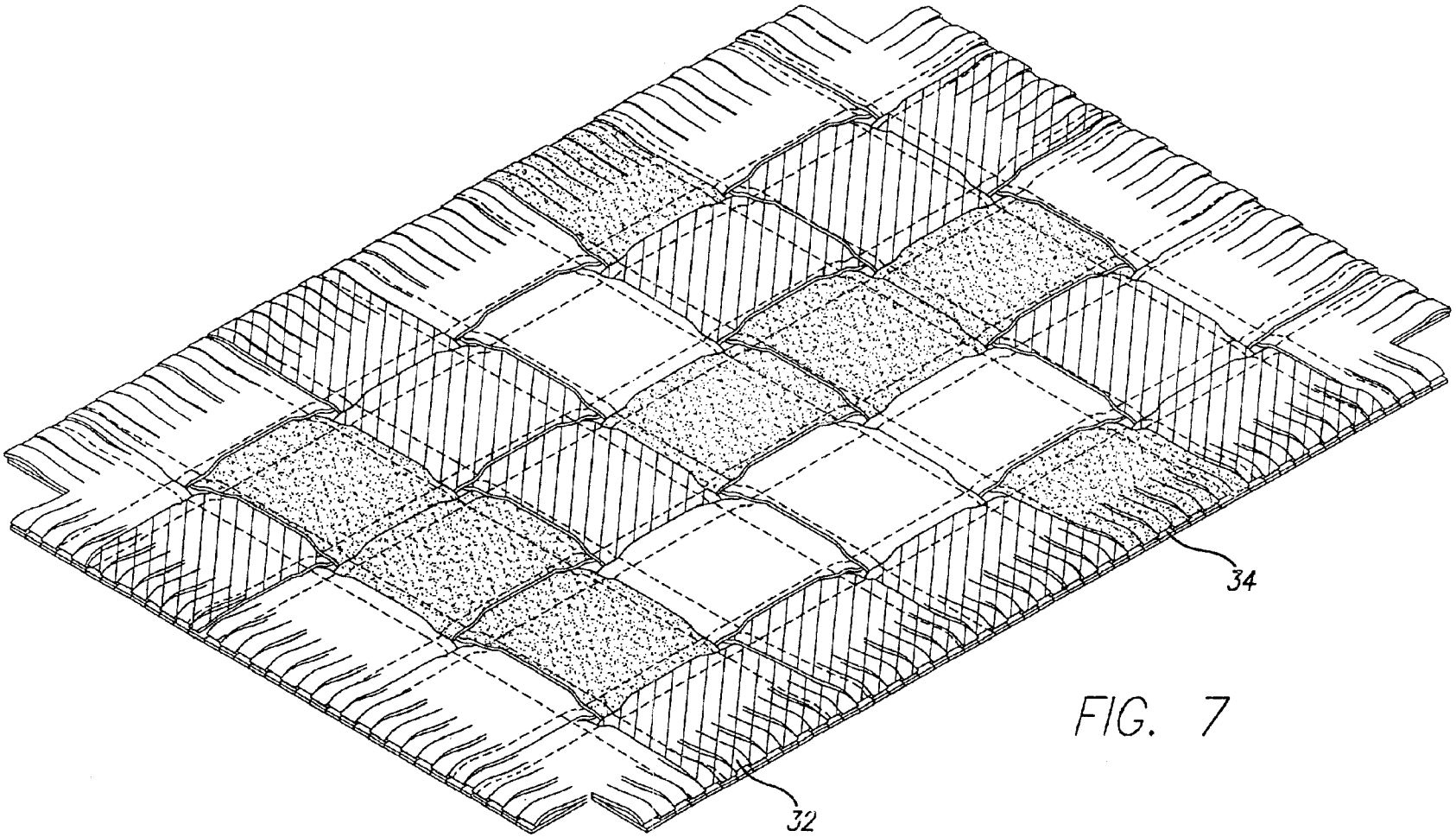
FIG. 7 is a perspective view of the fabric article according to the present invention bordered by fringe.

Referring more particularly to the drawings, FIG. 1 is a perspective view of the present invention depicting patchwork textile fabric article 10. Textile fabric article 10, which can constitute any type of cloth covering for a bed (e.g. a quilt) or a blanket throw, which can be used for some other purpose, is comprised of a plurality of fabric strips 12 sized according to the dimensions of the covering or textile fabric article desired. For example, a quilt approximately seven (7) feet by seven (7) feet might be formed from a series of fourteen (14) individual strips 14 each six (6) inches wide and seven (7) feet in length. Each strip 14 is placed juxtaposed to the next. A second series of fourteen (14) individual strips 16 each six (6) inches wide and seven (7) feet long is placed over and situated transverse to the first series of strips 14. Each strip 14 is then interlaced with strips 16, as shown in FIG. 4, until all the strips have been interlaced and caused to lay relatively flat. The interlaced strips 14, 16 are then secured by joining them together employing rows of sewn stitches 18 along a parallel line 20 recessed from edge(s) 22 along the two sides 24 of each strip. Sewing strips 14, 16 in this fashion helps to create the illusion of a patchwork pattern, which results from the apparent random arrangement of the fabric pieces or patchwork squares 26 observed upon both surfaces 28, 30. Adding to the illusion and contributing to the realistic simulation of a genuine patchwork pattern is the stitch motif and location, which allow for "free" or open edges 19 to be situated alongside the patchwork squares 26 on one surface 28 of fabric 10 and a finished edge 21 along the corresponding line on the reverse surface 30, as shown in FIG. 6.

Squares 26 are provided in a variety of colors, or color combinations. They can also be shown with a wide variety of indicia or ornamentation to enhance the simulation and interest of the patchwork design.

Fringes 32 can be formed from the edges 34 of the strips 14, 16 to further enhance the aesthetics and realism of the patchwork article.

The method of manufacture of the patchwork textile fabric 10 includes the steps of placing a first series of individual pieces of assorted textile fabrics formed into strips 14 of generally equal length and width in juxtaposed relation, placing a second series of individual pieces of assorted textile fabric formed into strips 16 of generally equal length and width in juxtaposed relation, arranging strips 14 in transverse relation to and covering strips 16, interlacing strips 14 and strips 16 to form a single thicker and stronger textile fabric product 10 with a top surface 28 and a bottom surface 30, arranging strips 14, 16 so that edges 22 overlap, and sewing stitches 18 along a line 20 parallel to and recessed from edges 22. Fringes 32 fashioned from edges 34 can be formed to enhance the strength, realism and aesthetics of the simulated patchwork pattern.

While the invention will be described in connection with a certain preferred embodiment and method, it is to be understood that it is not intended to limit the invention to that particular embodiment and method. Rather, it is intended to cover all alternatives, modifications and equivalents as may be included within the spirit and scope of the invention as defined by the appended claims.

What is claimed is:

1. A textile fabric comprising a plurality of pieces of fabric material cut into strips specifically shaped to be placed juxtaposed to one another and interlaced, said fabric material including a border portion formed as a fringe, and joined to produce a covering with a simulated patchwork design.

2. The invention of claim 1 wherein all or a portion of said fabric strips are marked with indicia to give the pattern of the textile fabric the overall appearance of a patchwork design.

3. In a textile fabric, the combination of a series of fabric strips each having a first and a second end portion and being of generally equal length and width, said strips being interlaced and juxtaposed, and alternatively transverse of one another and having overlapping edges, and a row of stitching extending along a generally parallel line relative to each of said edges and recessed therefrom, said combination of fabric strips formed to produce a quilt with a simulated patchwork design including a border portion formed as a fringe.

4. The invention of claim 3 wherein all or a portion of said fringed border is formed from the ends of said fabric strips having coordinating or contrasting colors or indicia.

5. The invention of claim 3 wherein said edges of each of said interlaced fabric strips only overlap on one side of said textile fabric.

6. A method of constructing a textile fabric simulating the appearance of a patchwork quilt comprising the steps of:

(a) providing a plurality of pieces of fabric material fashioned in strips of generally equal length and width, wherein the strips employ various colors and indicia and each said strip has an end portion;

(b) placing a first series of said strips in juxtaposed relation;

(c) placing a second series of said strips in juxtaposed relation transverse to said first series of said strips;

(d) interlacing said strips of said first series with said strips of said second series to form a top surface and a bottom surface of said textile fabric wherein said strips join to form a fringe around the border of said fabric;

(e) arranging said first and second series of strips so that their edges overlap along said bottom and said top surfaces in a prescribed sequence; and (f) stitching said first and second series of strips along a line generally parallel to each of said edges and recessed therefrom.

7. A textile fabric comprising a plurality of pieces of fabric material fabricated into strips juxtaposed to one another and interwoven and sewn together to produce a quilt with a simulated patchwork design, said pieces of fabric having end portions formed as a fringe.

8. In a textile fabric, the combination of a series of juxtaposed fabric strips each having end portions and being of generally equal length and width, said strips being interlaced and arranged transversely to one another and having overlapping edges cut to form a fringe and a row of stitching extending along a generally parallel line relative to each of said edges and recessed therefrom, said combination formed to produce a quilt with a simulated patchwork design.

9. A method of constructing a textile fabric with the simulated appearance of a patchwork quilt comprising the steps of:

(a) providing a plurality of pieces of fabric material fashioned from strips of generally equal length and width, wherein the strips employ various colors and indicia and each said strip has an end portion;

(b) placing a first series of said strips in juxtaposed relation;

(c) placing a second series of said strips in juxtaposed relation transverse to said first series of said strips;

(d) interlacing said strips of said first series with said strips of said second series to form a top surface and a bottom surface of said textile fabric;

(e) arranging said first and second series of strips so that their edges overlap along said bottom and said top surfaces;

(f) stitching said first and second series of strips along a line parallel to each of said edges and recessed therefrom;

(g) employing the end portions to form a fringe.

* * * * *